United States Patent [19]

Tanaka et al.

[11] 4,392,506

[45] Jul. 12, 1983

[54] APPARATUS FOR CONVEYING TUBULAR MATERIALS IN PICKLING FACILITIES OF THE SAME

[75] Inventors: Yoshiro Tanaka; Hayato Moroi; Yukihiko Komatsu; Kazuo Akagi; Ryujiro Shitamatsu, all of Shimonoseki; Tadashi Nishimura, Yokohama, all of Japan

[73] Assignee: Kabushiki Kaisha Kobe Seiko Sho, Kobe, Japan

[21] Appl. No.: 307,670

[22] Filed: Oct. 1, 1981

[30] Foreign Application Priority Data

Aug. 12, 1981 [JP] Japan ..... 56-120155[U]

[51] Int. Cl.[3] ..... B08B 3/04

[52] U.S. Cl. ..... 134/46; 134/76; 134/83

[58] Field of Search ..... 134/46, 56 R, 76, 83

[56] References Cited

U.S. PATENT DOCUMENTS

| | | | |
|---|---|---|---|
| 2,120,843 | 6/1938 | Shoemaker | 134/46 |
| 2,245,673 | 6/1941 | Huenerfauth | 134/76 |
| 2,811,262 | 10/1957 | Schaitberger | 134/76 X |
| 2,903,994 | 9/1959 | Hrubec | 134/46 X |
| 3,474,800 | 10/1969 | Gilewski | 134/46 |
| 3,887,094 | 6/1975 | Ikeda et al. | 134/76 X |
| 4,331,230 | 5/1982 | Buckley | 134/83 X |

FOREIGN PATENT DOCUMENTS

| | | | |
|---|---|---|---|
| 923046 | 4/1963 | United Kingdom | 134/83 |

*Primary Examiner*—Robert L. Bleutge

*Attorney, Agent, or Firm*—Oblon, Fisher, Spivak, McClelland & Maier

[57] ABSTRACT

An apparatus for conveying tubular members along a plurality of treatment liquid tanks in pickling facilities. The apparatus includes a pair of guide rails and a travelling car adapted to reciprocate on the guide rails. The travelling car includes at least one pair of tube-supporting hooks which can be reciprocated upwardly and downwardly and turned between positions parallel to the rails and other positions perpendicular to the rails. The tube-supporting hooks can be lowered or raised independently so as to support the tubular members aslant near the treatment liquid level in each of the treatment liquid tanks, thereby allowing immersion of the tubular members into the treatment liquid or retraction of the tubular members out of the treatment liquid without forming considerable air bubbles in the liquid. Since such bubbles are known to develop stains on the tubular members, tubular members of high surface quality can be obtained. The above apparatus also permits a smooth, simple and efficient conveyance and loading and unloading of tubular members between the treatment liquid tanks.

11 Claims, 8 Drawing Figures

APPARATUS FOR CONVEYING TUBULAR MATERIALS IN PICKLING FACILITIES OF THE SAME

BACKGROUND OF THE INVENTION

1. Field of the Invention

This invention relates to an apparatus for conveying tubular members such as pipes having a circular cross-section and made of zirconium, a zirconium alloy, stainless steel or the like in pickling facilities for the same.

2. Description of the Prior Art

As is well-known, a product made of zirconium, a zirconium alloy, stainless steel or the like, for example, a zircaloy tube as a cladding tube for nuclear fuel or the like has to be mirror-finished by pickling both inner and outer surfaces thereof with an acidic solution such as nitric acid and/or fluoric acid after polishing only the outer surface thereof to a roughness factor of about 6S or so subsequent to its final annealing step.

In such pickling facilities, it is necessary to degrease the tubular members and wash them with water of a high temperature prior to subjecting them to a pickling treatment. Furthermore, subsequent to the pickling treatment, it is also necessary to treat the thus-pickled tubular members in a tank containing an alkaline solution as well as in a tank containing purified water. Therefore, it is indispensable to convey tubular members to each treatment liquid tank and load the same in the tank to dip the tubular members therein. Here it is very important to carry out the conveyance in a predetermined sequence from one tank to another as well as to perform the loading and unloading in each tight treatment liquid tank while avoiding any damage to the surfaces of the tubular members.

SUMMARY OF THE INVENTION

The present invention has been completed in view of the above-described requirement for a pickling treatment. According to one aspect of this invention, an apparatus is provided for conveying tubular materials in pickling facilities for the same. The pickling facilities include a plurality of treatment liquid tanks disposed in series. The apparatus includes a pair of guide rails arranged, respectively, in the direction of the arrangement of the tanks and along their corresponding sides of the tanks, a travelling car adapted to reciprocate on the guide rails, at least one pair of tube-supporting hooks provided with the travelling car spaced in the widthwise direction relative to the guide rails, an elevating mechanism provided with the travelling car for moving each of the tube-supporting hooks upwardly and downwardly, a swivel drive mechanism provided with the travelling car for turning each of the tube-supporting hooks between a position parallel to the lengthwise direction of the rails and a position perpendicular to the same lengthwise direction, a horizontal position detector for stopping and starting the travelling car at a position corresponding to each of the treatment liquid tanks, and a vertical position detector for sensing the position of each of the tube-supporting hooks at locations both below and above the liquid level in each of the treatment liquid tanks, the vertical position detector and its corresponding elevating mechanism being interlockingly connected together.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
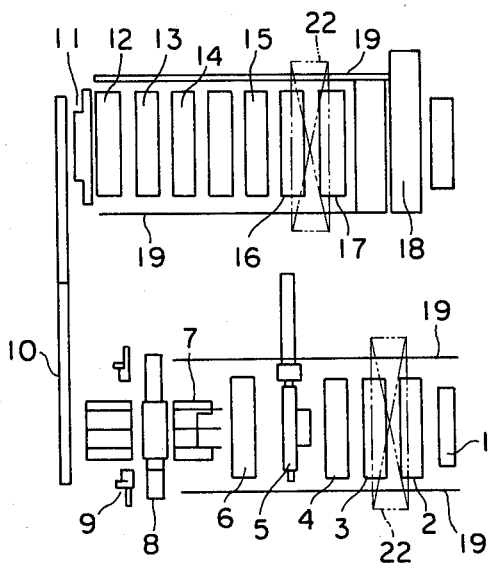
FIG. 1 is a plan view of the overall pickling facilities of the present invention.

In FIG. 1 schematically illustrating the overall arrangement of the pickling facilities, there are provided in order a stock table 1, a high-temperature water tank 2, a first degreasing tank 3, a second degreasing tank 4, tube interior cleaning apparatus 5, a high-temperature water tank 6, a stock table 7, a tube interior pickling apparatus 8, a plugging machine 9, a tube exterior pickling apparatus 10, an unplugging machine 11, a slightly warm water tank 12, an alkaline water tank 13, high-temperature water tanks 14, 15, purified water tanks 16, 17 and a drying chamber 18. After subjecting tubular members to their final annealing processing and polishing only the outer surfaces of the tubular members such members are conveyed to the pickling facilities. Then, they are charged into the treatment liquid tanks sequentially from the stock table 1 and their inner and outer surfaces are subjected to pickling treatment. Then, the thus-pickled tubular members are fed through the cleaning liquid tanks and finally conveyed into the drying chamber 18.

The subject matter of the present invention is applied to the pickling apparatus shown in FIG. 1. Namely, the present invention relates to the conveyance and loading and unloading of tubular members from the stock table 1 to the tube interior pickling apparatus 8 as well as to the conveyance and loading and unloading from the slightly warm water tank 12, which receives tubular members from the tube exterior pickling apparatus 10, to the drying chamber 18.

Referring now to FIG. 2 through FIG. 6, the conveyance and loading and unloading of tubular members will be described with respect to the tube interior pickling apparatus 8. As is apparent from the drawings, the first high-temperature water tank 2, the first and second degreasing tanks 3, 4, tube interior cleaning apparatus 5 and the second high-temperature water tank 6 are disposed in series with a predetermined interval. In other words, a plurality of such treatment liquid tanks are arranged in series.

Numeral 19 indicates guide rails extending parallelly to each other along the arrangement direction of the aforementioned treatment liquid tanks. In the illustrated embodiment, posts 20 are provided upright in pairs along both sides of the treatment liquid tanks with a predetermined interval. Guide rails 19 are built into so-called elevated rail structures by providing the rails 19 on the tops of their respective posts. Both rails 19 are provided respectively with rack rails 21 which extend in parallel with their corresponding rails 19.

Numeral 22 indicates a travelling car which moves back and forth on the above-described guide rails 19. On the travelling car 22 is mounted a support frame 23 assembled into a rectangular shape in plan view, on which a reversible motor 24 equipped with a brake is mounted. Motor 24 and a drive shaft 25 are interlockingly connected by a wrapping connector 26, and drive pinions 27 provided respectively at opposite ends of the drive shaft 25 engage their corresponding rack rails 21. In addition, the support frame 23 is also provided with four wheels 28 arranged in a diagonal pattern in plan view. Thus, by allowing the wheels 28 to rotate on the guide rails 19 around their respective shafts, the travelling car 22 can be freely reciprocated as shown by arrows in FIG. 4.

Figure 5:
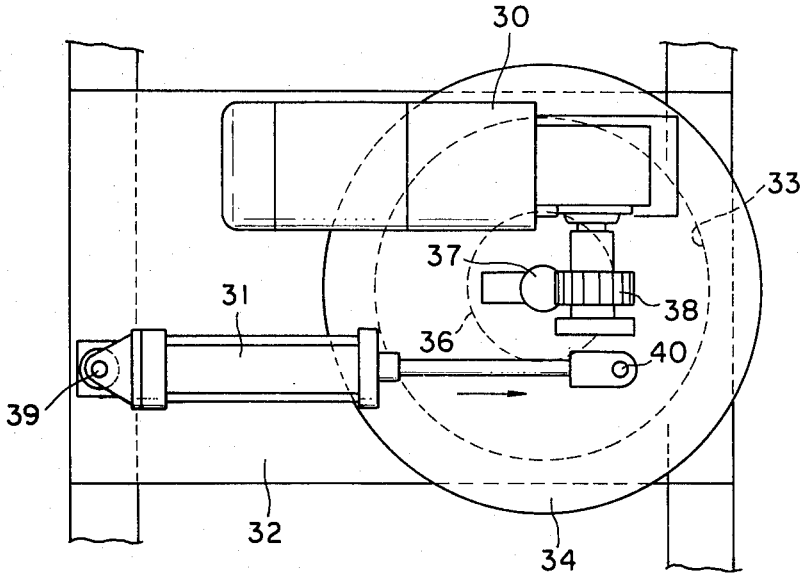
FIG. 5 is an enlarged plan view of a swivel drive device system.
Figure 6:
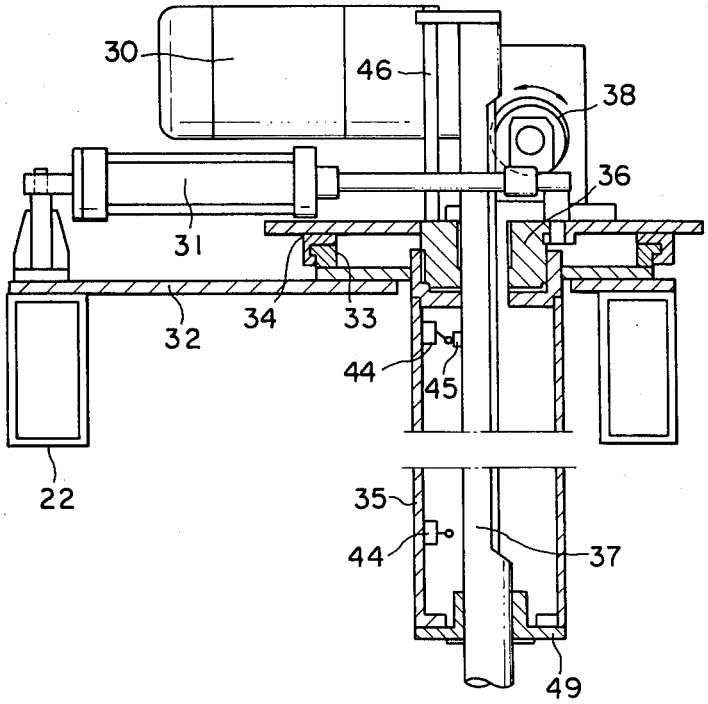
FIG. 6 is a cross-sectional view of the swivel drive device system.

Numeral 29 designates tube-supporting hooks, which are vertically displaceably provided with the travelling car 22 through their corresponding elevating mechanism 30 and are also turnable about their respective vertical central axes by means of their respective swivel drive mechanism 31. As shown in FIG. 5 and FIG. 6, attachment tables 32 are mounted on the support frame 23 across the width of the guide rails 19. A flattened cup-like member 33 having a circular bottom wall and short upright wall extending upwardly from the circumference of the bottom wall is fixedly secured to each of the attachment tables 32, to which member 33 is engaged a turntable 34.

The flattened cup-like member 33 includes a tube 35 extending downwardly from the bottom wall thereof. A cylindrical bearing 36 fixedly secured to the turntable 34 is rotatably fitted in the tube 35 and, furthermore, a rack shaft 37 extends axially through the cylindrical bearing 36 in such a fashion that the rack shaft 37 can rotate freely relative to the bearing 36. At the lower extremity of the rack shaft 37 the tube-supporting hook 29 is detachably provided.

Figure 2:
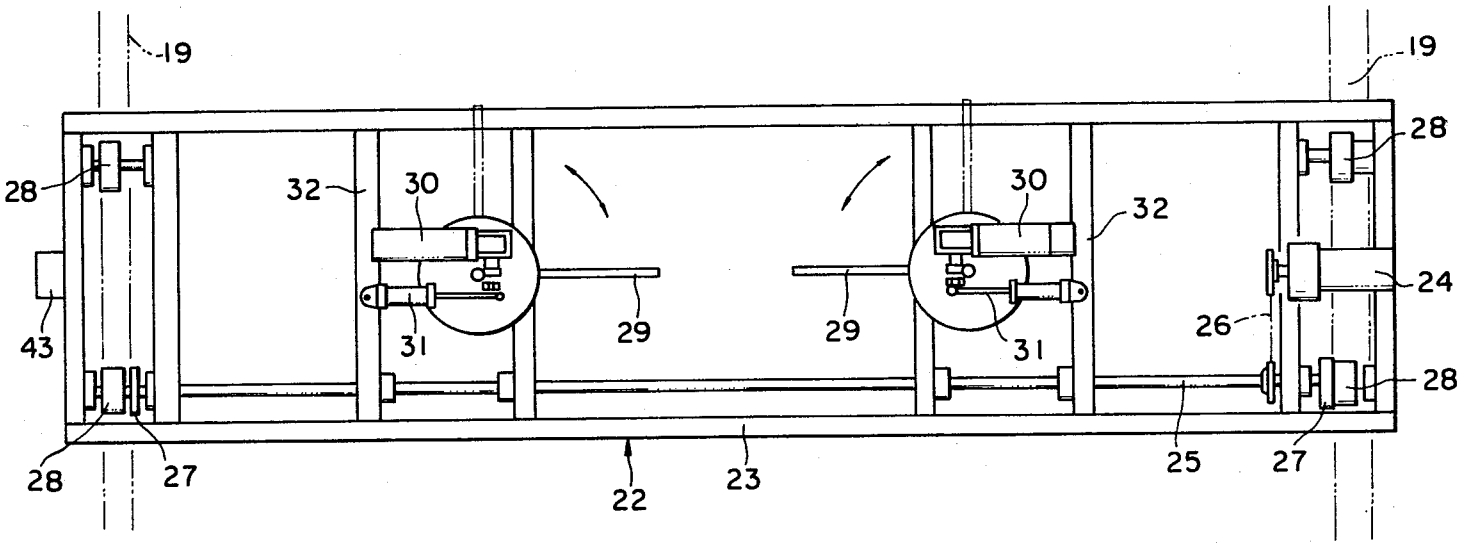
FIG. 2 is a plan view of one embodiment of the travelling car according to this invention, which travelling car constitutes principal features of the present invention.

The elevating mechanism 30 is a reversible motor mounted on the turntable 34. A pinion 38, which is driven by the motor 30, is engaged with its corresponding rack shaft 37. On the other hand, the swivel drive mechanism 31 is an expansion fluid cylinder and its cylinder tube is pivotally secured to the attachment table 32 through a pivot post 39 while its piston ram is also pivotally attached to the turntable 34 via a pivot pin 40. Accordingly, by the actuation of the swivel drive mechanism 31 or in other words, its expansion and retraction operation, its corresponding tube-supporting hook 29 can be freely turned between a position parallel to the lengthwise directions of the rails 19 and another position perpendicular to the same lengthwise directions as illustrated in FIG. 2.

Designated at numeral 41 is a horizontal position detector for the travelling car 22. In the illustrated embodiment, position sensors 42 of either contact or non-contact type are provided respectively at locations corresponding to treatment fluid tanks such as the high-temperature water tank 2, decreasing tank 3, etc. On the other hand, another position sensor 43 is provided on the travelling car 22 and interlockingly connected to the reversible motor 24 so as to allow the travelling car 22 to stop above any desired treatment liquid tank and then to start after the lapse of a predetermined time period.

Numeral 44 designates a vertical position detector for the tube-supporting hook 29 or, in other words, the rack shaft 37. In order to allow independent detection of positions of each of the tube-supporting hooks 29 at at least two locations, namely, at a position submerged below the liquid level and another position somewhat above the liquid level, a plurality of limit switches 44 are provided in each tube 35 (namely, in the illustrated embodiment, three limit switches 44 for the detection of a lower dead end position, a middle position and an upper dead end position) whereas a switch actuator 45 is provided on the rack shaft 37 so as to actuate the switches 44. Switches 44 are each connected interlockingly with the above-mentioned elevating mechanism 30.

In FIG. 6, numeral 46 indicates a stopper which is provided at a top portion of the rack shaft 37 so as to prevent the tube-supporting hook 29 from accidentally colliding against the bottom of the tank when the hook 29 is submerged below the liquid level.

Figure 3:
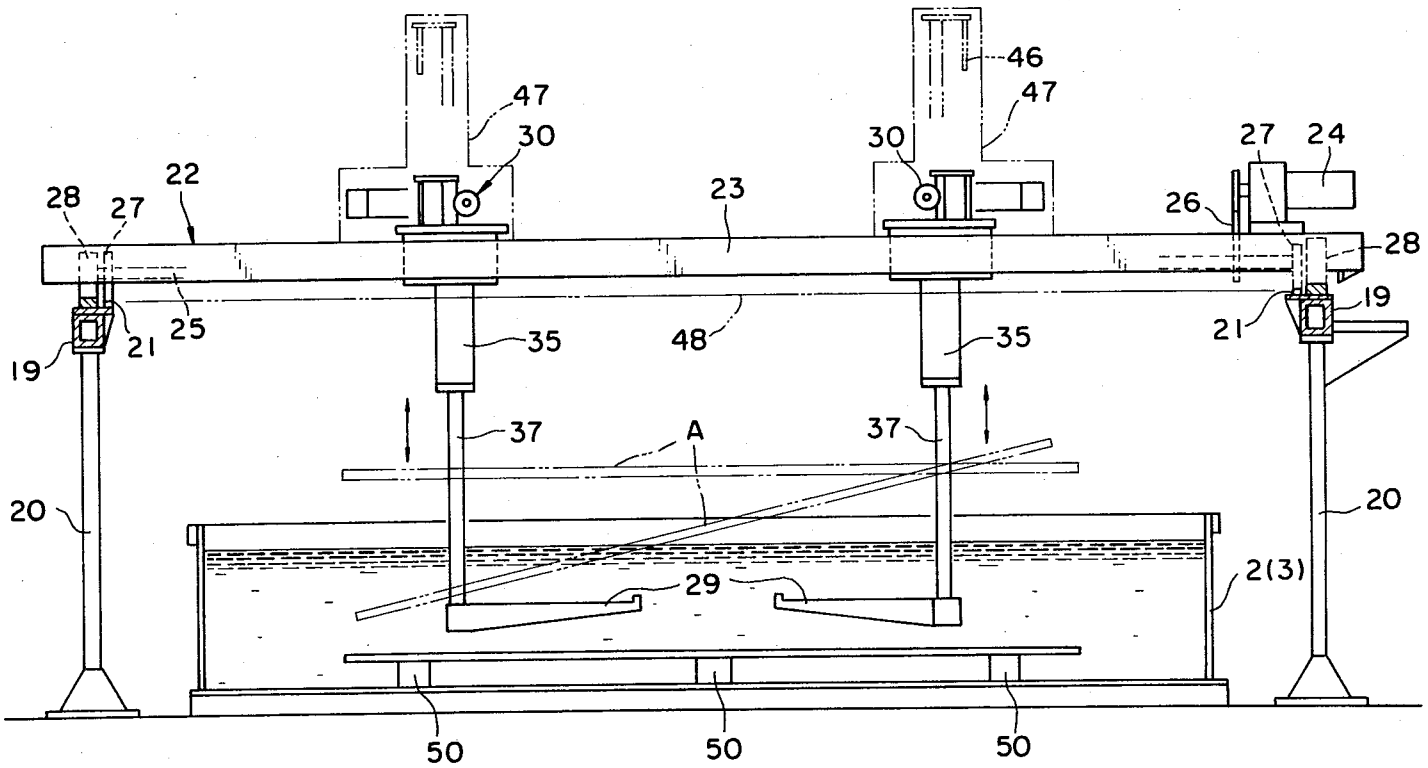
FIG. 3 is a cross-sectional, front elevational view of the travelling car.
Figure 4:
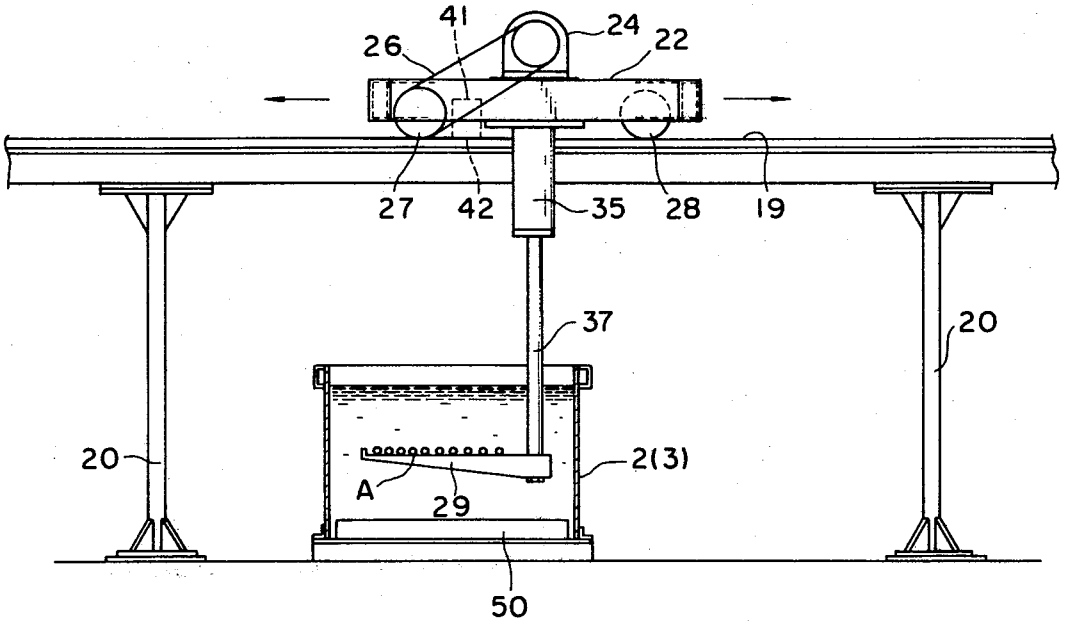
FIG. 4 is a cross-sectional, side elevational view of the travelling car.

Referring now back to FIG. 3, a cover for each of the elevating mechanisms 30 and swivel drive mechanisms 31 is indicated by numeral 47 while numeral 47 denotes a main under cover for the travelling car 22. Numeral 49 indicates a sealing lid for each of the tubes 35 (see FIG. 6) and numeral 50 designates a supporting stand sunken in each treatment liquid tank to support tubular materials thereon during their treatment (see FIG. 3 and FIG. 4).

Figure 7:
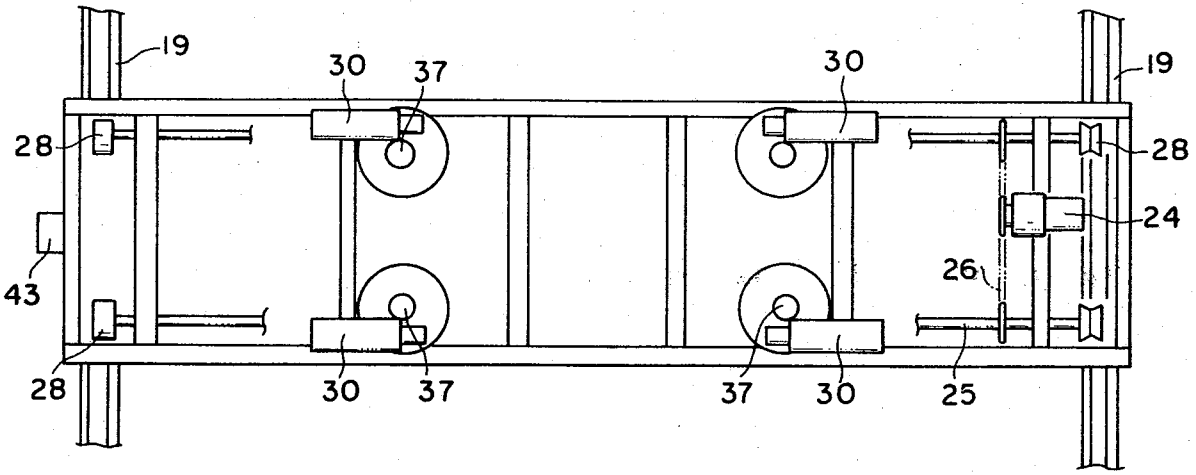
FIG. 7 is a plan view of another embodiment of the travelling car according to this invention.
Figure 8:
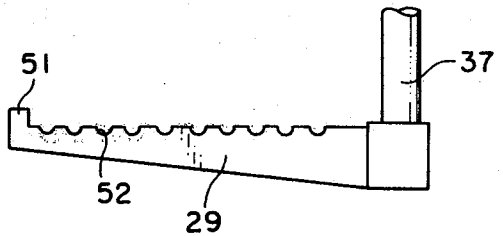
FIG. 8 is an enlarged view of a tube-supporting hook.

Travelling car 22 shown in FIG. 7, which is adapted after pickling the outer surfaces of tubular members, is provided with four tube-supporting hooks 29. As depicted in FIG. 8, each tube-supporting hook 29 preferably has at its free end an upright projection 51 for the prevention of any accidental drop of tubular members. It is also desirous to form recesses 52 in a row at the tube-supporting portion in order to support tubular members in a mutually separated state.

Next, an example of the conveyance and loading and unloading operation of tubublar members A from the stock table 1 to the tube interior pickling apparatus 8 will be described. The tubular members A on the stock table 1 are dipped into the high-temperature water tank 2, conveyed from the high-temperature water tank 2 to the degreasing tank 3, and dipped again therein by vertical displacement and swivel motions of the tube-supporting hooks 29 provided with the travelling car 22. First of all, the tubular members A on the stock table 1 are conveyed to and loaded in the high-temperature water tank 2 one by one or with several tubular members together each time.

Namely, the pair of tube-supporting hooks 29 provided with the travelling car 22 are raised upwardly in positions parallel to the lengthwise directions of the rails 19 by virtue of the lifting actions of their respective elevating mechanisms 30, thereby lifting the tubular members A from the stock table 1 simultaneously at both ends of the tubular members A. Then, by actuating the driving mechanism 24 of the travelling car 22 in the normal direction, the travelling car 22 moves to a point above the high-temperature water tank 2, where the travelling car 22 is detected by the horizontal position detector 41 and stopped there.

Then, both of the elevating mechanisms 30 are actuated to lower their respective hooks 29. In the illustrated embodiment, the pair of tube-supporting hooks 29 are synchronously lowered through their respective pinions 38 and rack shafts 37. As exemplified in FIG. 3, the hooks 29 are detected by their respective switches 44 when they have reached positions slightly above the liquid level.

After the detection of the hooks 29 by the switches 44, one of the elevating mechanisms 30 is actuated again to lower its corresponding hook 29 in advance to the other hook 29, thereby causing one end of each tubular member A to submerged underneath the liquid level prior to the other end thereof and thus allowing the gradual discharge of air in the tubular member A by the treatment liquid or water (see FIG. 3). Upon completion of the substitution of air with the treatment liquid or water, the other elevating mechanism 30 is actuated to lower its respective hook 29 completely below the liquid level. Thus, the tubular members A can be immersed in the treatment liquid or water on the supporting stands 50 in the tank such that no air remains in the tubular members A.

After the tube-supporting hooks 29 have left the tubular members A on the supporting stands 50 through the downward extension of their respective rack shafts 37, the tube-supporting hooks 29 are turned in a direction perpendicular to the rails 19 and pulled above the liquid level through the upward retraction of their respective rack shafts 37. Then, the travelling car 22 is moved to another treatment liquid tank by an actuation of the driving mechanism 24.

When the treatment of the tubular members A in the high-temperature water tank 2 has been completed, the travelling car 22 stops again above the tank 2 and the hooks 29 are lowered and turned for conveying the tubular members A to the subsequent degreasing tank 3.

Namely, the tube-supporting hooks 29 are turned below the tubular members A on the supporting stands 50 to assume positions parallel to the lengthwise direction of the rails 19, in other words, positions ready to lift up the tubular members A. Thereafter, one of the elevating mechanisms 30 is actuated in advance so as to pull up the corresponding end portions of the tubular members A above the liquid level. The lifting of the other hook 29 is delayed so that the treatment liquid within the tubular members A can flow back into the treatment liquid. These critical positions of the tube-supporting hooks 29 are detected by means of the limit switches 44, whereby interlockingly operating the elevating mechanism 30 to return the treatment liquid within the tubular members A in its entirety back into the tank without unnecessarily disturbing the treatment liquid in the tank. Then, upon detecting both hooks 29 having been pulled above the liquid level, both hooks 29 are levelled and hoisted together. The dipping operation of the tubular members A into the degreasing tank 3 is identical to that into the high-temperature water tank 2.

The operation of the apparatus of this invention is carried out as described above. The tube-supporting hooks 29 can travel over a plurality of treatment liquid tanks, for example, the high-temperature water tank 2 and degreasing tank 3 owing to the provision of the elevating mechanism 30 and swivel drive mechanism 31 both mounted on the travelling car 22. It has thus become possible to conduct the dipping and pulling-up of the tubular members A while minimizing disturbance to the treatment liquid in each treatment liquid tank. More particularly, since the interlocked control of the elevating mechanism 30 by the limit switches 44 permits immersion of the tubular members A gradually into the treatment liquid from ends thereof, the air within the tubular members A does not remain as bubbles in the treatment liquid. On the other hand, it is also possible to slowly return the treatment liquid within the tubular members A back to the tank as the tubular members A can be pulled out of the treatment liquid from their one end and can be made aslant. Thus, it has become feasible, in the pretreatment step or finishing step of pickling facilities, to eliminate the development of stains, scratches or the like which considerably affects against the quality of tubular members. Thus, the apparatus of the present invention permits the conveyance of tubular members under smooth, simple and stable conditions, thereby bringing about a great advantage from a practical viewpoint.

Needless to say, the drawings show merely certain embodiments of this invention. Thus, a wide variety of design modifications may be freely effected, for example, by replacing the elevated guide rails by rails constructed on the floor or by using as the horizontal position detector of the travelling car a control system for detecting the travelling motion of the travelling car and rotation of its driving motor.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. An apparatus for conveying tubular members in pickling facilities for the same, said pickling facilities including a plurality of treatment liquid tanks disposed in series, said apparatus comprising:

a pair of guide rails arranged respectively in the direction of the arrangement of the tanks and along corresponding sides of the tanks;

a travelling car reciprocably disposed on the guide rails;

at least one pair of tube-supporting hooks mounted on the travelling car and spaced in the widthwise direction relative to the guide rails;

elevating means operatively connected with the travelling car for moving each of the tube-supporting hooks upwardly and downwardly;

swivel drive means operatively connected with the travelling car for turning each of the tube-supporting hooks between a position parallel to the lengthwise direction of the rails and a position perpendicular to the lengthwise direction of the rails;

a horizontal position detector for stopping and starting the travelling car at a position corresponding to each of the treatment liquid tanks;

a vertical position detector for sensing the position of each of the tube-supporting hooks at locations both below and above the liquid level in each of the treatment liquid tanks; and means for interlockingly connecting the vertical position detector and said elevating means.

2. The apparatus as claimed in claim 1, further comprising a plurality of rack rails disposed in parallel with their corresponding guide rails of said pair of guide rails and a plurality of drive pinions connected to the travelling car at opposite sides thereof, said drive pinions engaging with their respective rack rails, thereby allowing the travelling car to move back and forth along the guide rails.

3. The apparatus as claimed in claim 1, wherein the swivel drive means further comprises an expansion fluid cylinder with a piston ram and pivotally mounted on the travelling car and further comprising a fixed attachment table and a turntable pivotally connected to the free end of the piston ram of the fluid cylinder for mounting said fluid cylinder to said travelling car.

4. The apparatus as claimed in claim 1, wherein the elevating means further comprises a horizontally disposed stationary drive pinion and a vertically disposed rack shaft engaged with the drive pinion.

5. The apparatus as claimed in claim 1, further comprising a fixed attachment table and wherein said swivel drive means further comprises an expansion fluid cylinder with a piston ram, a turntable pivotably connected to a free end of the piston ram, a fixed attachment table connected to said cylinder and pivotably connecting said turntable to said travelling car, a flattened cup-like member having a circular bottom wall and short upright wall extending upwardly from the circumference of the bottom wall and fixedly secured at the bottom wall thereof to the travelling car through said fixed attachment table, said turntable being engaged with the upright wall of the flattend cup-like member, a vertically elongated tube fixedly attached to the bottom wall of the flattened cup-like member, and a rack shaft mounted on the turntable, said rack shaft extending rotatably relative to and through the tube and terminating in the tube-supporting hook at the lower end thereof; and wherein the elevating means further comprises a reversible motor mounted on the turntable and a drive pinion engaged with the rack shaft and driven by the reversible motor.

6. The apparatus as claimed in claim 5, wherein the vertical position detector further comprises a plurality of limit switches mounted on the inner wall of the tube with a predetermined interval and a switch actuator connected to the rack shaft.

7. The apparatus as claimed in claim 4, 5 or 6, further comprising a stopper mounted on a top portion of the rack shaft so as to prevent the tube-supporting hook from colliding against a bottom wall portion of each of the treatment liquid tanks.

8. The apparatus as claimed in claim 1, 4, 5 or 6, wherein the horizontal position detector further comprises a position sensor mounted on the travelling car at one side thereof and a plurality of corresponding position sensors disposed respectively at locations corresponding to the plurality of treatment liquid tanks, and means interlockingly connected with the position sensor on the travelling car for driving the travelling car so as to permit the travelling car to stop above each of the treatment liquid tanks.

9. The apparatus as claimed in claim 1, 4, 5 or 6, wherein each of said tube-supporting hooks further comprise an upright projection at the free end thereof for preventing accidental dropping of tubular members therefrom and a plurality of recesses spacedly formed in a tube-supporting part thereof to support the tubular members thereon in a mutually spaced fashion.

10. The apparatus as claimed in claim 1, 4, 5 or 6, further comprising means for lowering or raising the tube-supporting hook at one side of the travelling car independently from the tube-supporting hook on an opposite side of the travelling car.

11. The apparatus as claimed in claim 5, further comprising:

means, when immersing the tubular members into the treatment liquid in one of the plurality of treatment tanks, for synchronously lowering the tube-supporting hooks until reaching a position slightly above the liquid level in said one treatment liquid tank;

means for further lowering either one of the tube-supporting hooks into the treatment liquid while holding the remaining tube-supporting hook at the same position so as to substitute air within the tubular members by the treatment liquid;

means for thereafter lowering the remaining tube-supporting hook so as to dip the tubular materials completely in the treatment liquid; and means for raising either of said tube-supporting hooks out of the treatment liquid, when pulling the tubular members out of the treatment liquid, to a position slightly above the liquid level while still holding the remaining tube-supporting hooks in the treatment liquid so as to allow the treatment liquid to flow back into the treatment tank at a position below the liquid level.

* * * * *